United States Patent [19]

Waelti

[11] Patent Number: 4,936,051

[45] Date of Patent: Jun. 26, 1990

[54] METHOD AND DEVICE FOR TRIMMING GRINDING WHEELS

[75] Inventor: Werner Waelti, Selzach, Switzerland

[73] Assignee: Werkzeugmaschinenfabrik Tschudin, Grenchen, Switzerland

[21] Appl. No.: 269,769

[22] PCT Filed: Jan. 20, 1988

[86] PCT No.: PCT/CH88/00011

§ 371 Date: Sep. 23, 1988

§ 102(e) Date: Sep. 23, 1988

[87] PCT Pub. No.: WO88/05367

PCT Pub. Date: Jul. 28, 1988

[30] Foreign Application Priority Data

Jan. 25, 1987 [CH] Switzerland ..... 241/87

[51] Int. Cl.[5] ..... B24B 53/053

[52] U.S. Cl. ..... 51/5 D; 125/11.01; 125/11 B; 125/11 BS; 125/11.15; 125/11.16

[58] Field of Search ..... 125/11 R, 11 CD, 11 AT, 125/11 AS, 11 A, 11 B, 11 BS, 28; 51/325, 5 D

[56] References Cited

U.S. PATENT DOCUMENTS

| | | | |
|---|---|---|---|
| 155,052 | 9/1874 | Uhlinger | 125/28 |
| 2,641,873 | 6/1953 | Haas | 125/11 B |
| 3,079,905 | 3/1959 | Catallo et al. . | |
| 4,443,975 | 4/1984 | German et al. | 51/5 D |
| 4,510,716 | 4/1985 | German et al. | 51/5 D |

FOREIGN PATENT DOCUMENTS

| | | | |
|---|---|---|---|
| 534073 | 1/1932 | Fed. Rep. of Germany . | |
| 2510393 | 9/1976 | Fed. Rep. of Germany . | |
| 3437682 | 5/1985 | Fed. Rep. of Germany | 125/11 R |
| 1361643 | 6/1963 | France | 125/11 R |
| 848325 | 7/1981 | U.S.S.R. | 51/5 D |
| 374588 | 7/1932 | United Kingdom . | |
| 1462343 | 9/1975 | United Kingdom | 51/5 D |

*Primary Examiner*—Frederick R. Schmidt
*Assistant Examiner*—Blynn Shideler
*Attorney, Agent, or Firm*—Sherman and Shalloway

[57] ABSTRACT

In order to eliminate the need, during operation, to continually redefine the grinding line (SL 2) between the trimming wheel (12) and the gripping wheel (10), and the need to re-zero the C-axis after each trimming step by the grinding wheel (12) on the grinding wheel (10) in a grinding machine, a trimming wheel (12) with a separate drive (11) is mounted directly on the turning slide (1) instead of on the rotary table (2) of the grinding machine. The said grinding line (SL 2) is thus not displaced when the C-axis is zeroed, but rather is held in a defined position with respect to the longitudinal axis (Z-axis) and to the B-axis perpendicular thereto of the grinding machine. To enable the quality and precision of the trimming to be increased, a trimming wheel (12) is employed which can be mounted on a conical receiving piece which is in turn mounted on a shaft having two bearings.

4 Claims, 3 Drawing Sheets

METHOD AND DEVICE FOR TRIMMING GRINDING WHEELS

BACKGROUND OF THE INVENTION

1. Field Of The Invention

The invention relates to a method and device for trimming grinding wheels, advantageously by means of a diamond trimming wheel, on grinding machines. The invention also relates to a device for accomplishing the method.

2. Description Of The Prior Art

Customarily in the manufacturing of mechanical devices, particularly precision mechanical devices where it is desired to produce workpieces with fine dimensional tolerances and finely ground surfaces, the grinding step or steps is/are carried out on a grinding machine wherein the workpiece to be ground is held on a rotary table, disposed on the turning slide, between headstock and a tailstock. The turning slide is translatable along the longitudinal axis (Z-axis) of the grinding machine. In addition, the rotary table can be rotated with respect to the turning slide around a vertical axis (B-axis) of the grinding machine, such that the workpiece spinnably held along the axis defined by the headstock and tailstock (the C-axis) is three dimensionally positionable with respect to the grinding wheel, which wheel is spinnable around its own rotational axis (A-axis) and is translatable along an additional axis (X-axis). Customarily, on such a grinding machine, which advantageously is numerically controlled (NC), the trimming wheel for the grinding wheel is mounted on the rotary table, such that said trimming wheel can advantageously be spun around the aforementioned C-axis around which the workpiece is rotated. Because when the movable slide is rotated around the aforesaid B-axis (whereby the C-axis is rotated around the B-axis) the C-axis is rotated away from the longitudinal axis (Z-axis) of the grinding machine, the grinding line between the grinding wheel and the trimming wheel may be spatially positioned as desired. While this freedom can be advantageous, it carries the drawback that the relation between the G-T grinding line (grinding line between grinding wheel and trimming wheel) and the G-W grinding line (grinding line between grinding wheel and workpiece) is not (or not always) directly calculable and must be re-zeroed after each trimming step in order to accurately determine the new position of the G-W grinding line. In addition, the position of the trimming wheel, which wheel customarily remains mounted on the turning slide during the grinding of a workpiece, is rotated, with respect to the grinding wheel, by each rotation of the turning slide as well as by the zeroing of the C-axis; and this necessitates a new zeroing of the trimming wheel prior to each trimming step.

SUMMARY OF THE INVENTION

The underlying problem of the invention is to devise a method and a device whereby these drawbacks can be eliminated, and by the use of which one can more efficiently grind workpieces and trim grinding wheels than by the use of customary methods and devices. In addition, the invention should afford higher precision and quality of grinding.

These problems are solved according to the invention by the provision of a method of trimming grinding wheels by means of a trimming wheel, particularly on an NC grinding machine with a turning slide (1) translatable along the horizontal Z-axis, said machine further comprised of a rotary table (2) disposed on the slide (1), which table is swingable around the vertical B-axis and accommodates, on the horizontal C-axis, the workpiece (7) which is to be ground, and further comprised of a grinding wheel (10) which spins around the A-axis and is translatable along the X-axis; characterized in that a trimming wheel (12) is employed which is directly mounted on the turning slide (1) so as to be spinnable around an additional horizontal axis (the C'-axis) and swingable around an additional vertical axis (the B'-axis), and which has a separate drive (11); and by the provision of an apparatus for trimming grinding wheels on an NC grinding machine, comprised of a turning slide (1) translatable along the horizontal Z-axis, further comprised of a rotary table (2) disposed on the slide (1), which table is swingable around the vertical B-axis and accommodates, on the horizontal C-axis, the workpiece (7) which is to be ground, and further comprised of a grinding wheel (10) which spins around the A-axis and is translatable along the X-axis, characterized in that said apparatus comprises a shaft (15) with a conical member (14) for receiving a trimming wheel (12) which wheel has a conical central bore, wherewith said shaft (15) has two bearings (16, 17), is driven by a worm drive (18), and is swingable around an axis (the B'-axis) which extends perpendicularly to it.

BRIEF DESCRIPTION OF THE DRAWING FIGURES

The inventive method and device will be described in more detail hereinbelow, with reference to the drawings.

DETAILED DESCRIPTION OF THE INVENTION

Figure 1:
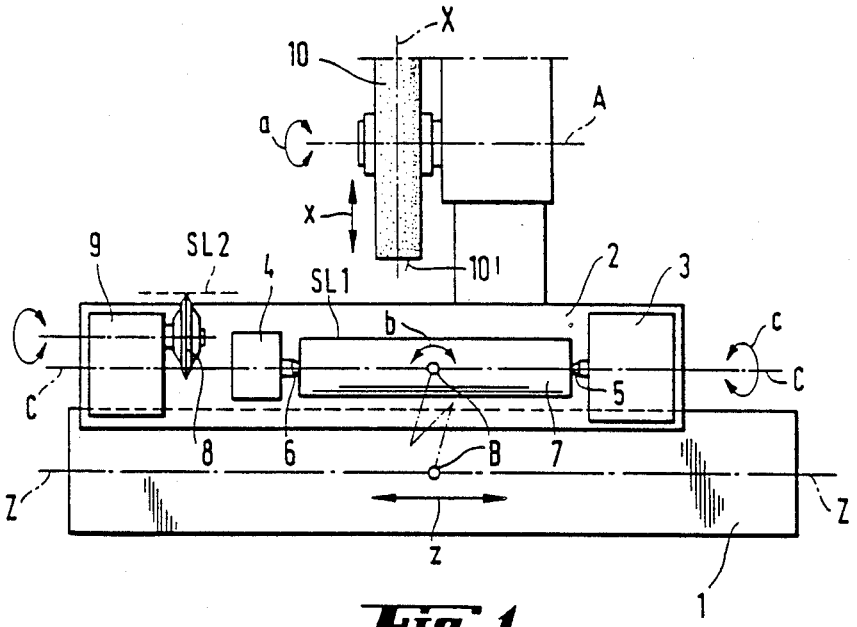
Fig. 1 PRIOR ART
FIG. 1 is a schematic top view of the disposition of the diverse components of a customary grinding machine with workpiece, grinding wheel, and trimming wheel, and their positional relations.

One skilled in the art will recognize in FIG. 1 a turning slide 1 which is translatable along the longitudinal axis (so-called Z-axis) of the grinding machine in the direction of the double arrow z. Slide 1 bears a rotary table 2 which is rotatable with respect to the turning slide 1 around the vertical axis of the grinding machine (so-called B-axis) in the direction of the double arrow b. For the sake of economy of depiction, and in particular to enable the individual axes of the grinding machine to be distinctly depicted, in the drawings (FIGS. 1 and 2) the rotary table 2 is shown laterally displaced with respect to the turning slide 1. The two points (open circles) through which the B-axis passes should properly be vertically superimposed (i.e., should coincide, in the top view of FIGS. 1 and 2). As a rule, a headstock 3 and tailstock 4 are mounted on the rotary table 2. The C-axis of the grinding machine is defined between their respective turning centers (5, 6). A workpiece 7, held between the centers (5, 6), can be spun around the C-axis in the direction of double arrow c. A trimming wheel 8 with drive unit 9 is seen to be also mounted on the rotary table 2. The purpose of the trimming wheel is to trim the grinding wheel 10 at regular intervals during the grinding of the workpiece 7, in order to ensure the desired grinding quality over the longest possible time. The grinding wheel 10 is spinnable around the A-axis of the grinding machine in the direction of double arrow a and is translatable along the X-axis in the direction of the double arrow x. The trimming of the grinding wheel is particularly important when using a profiled grinding wheel; by trimming one can prevent the consequences of a changed profile surface which results from wear of the grinding wheel, which consequences are namely, an imprecise ground shape of the workpiece.

A grinding line SL 1 is defined between the grinding wheel 10 and the workpiece to be ground 7. The workpiece 7 and grinding wheel 10 contact each other on this line SL 1 during the grinding. In order to be able to ensure that the workpiece 7 is ground precisely to the prescribed dimensions, it is absolutely necessary to have means of knowing the exact spatial position of the line SL 1 with respect to the C-axis and A-axis (and the circumferential line 10' of the grinding wheel). It is relatively convenient to determine the position of the rotational axis of the workpiece (the C-axis) with respect to the longitudinal axis (Z-axis) and the circumference 10' of the grinding wheel in order to be able to properly program the grinding. In NC grinding machines the appropriate values can be determined automatically by electronic measuring devices, and can be automatically entered into the grinding program. It is known that numerous workpiece shapes can be ground on a grinding machine of the customary type described hereinabove, with grinding proceeding by translating the rotary table 2 (and the turning slide 1 which bears table 2) along the double arrow z and simultaneously translating the grinding wheel 10 along the double arrow x, possibly also with rotation of the C-axis with respect to the Z-axis.

However, particularly in cases where the rotational axis of the workpiece 7 (thus, the C-axis) is rotationally displaced with respect to the longitudinal axis of the turning slide 1 (the Z-axis), there are difficulties in trimming the grinding wheel 10 with the trimming wheel 8, because the grinding line SL 2 defined by the circumference of the trimming wheel is displaced with respect to the circumference 10' of the grinding wheel 10 as the position, i.e. the attitude, of the rotary table 2 is changed. As a rule this leads to a situation where, even with an NC grinding machine, the grinding machine must be reset before and after each trimming step, in order to ensure that the exact spatial positions of the two grinding lines (SL 1 and SL 2) are known. This twofold resetting of the grinding machine is complex and time-consuming, and also, because of its complexity, it can be detrimental to the quality and precision of the grinding process.

Figure 2:
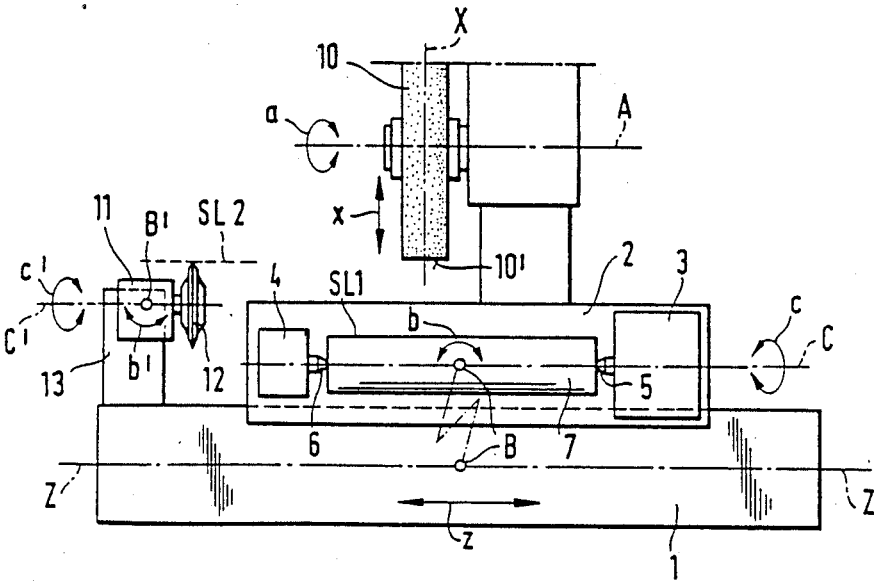
FIG. 2 is a schematic top view of the same components of a grinding machine equipped with an inventive device, and the positional relations of said components.

A comparable grinding machine is shown in FIG. 2, differing from that of FIG. 1 in that the trimming wheel 8 is not attached to the rotary table 2 but is affixed to the turning slide 1 by means of an inventive device. The inventive device is comprised essentially of a drive 11 and a support structure 13 (FIG. 3) for the trimming wheel 12. The drive 11 defines a rotational axis C' around which the trimming wheel 12 is rotatable in the direction of the double arrow c'; and drive 11 also defines a vertical axis B' parallel to the B-axis, wherewith the said C'-axis is rotatable around the B'-axis. If, for a specific rotational position of the B'-axis, the grinding line SL 2 between the trimming wheel 12 and the grinding wheel 10, i.e. the spatial orientation of the circumference of the trimming wheel 12 with respect to the Z-axis, has been defined prior to a grinding step, the said line SL 2 will remain unchanged with respect to the turning slide 1, despite any swinging of the C-axis or translation of the rotary table 2, and any movement of said line SL 2 will be parallel to the turning slide 1 and the Z-axis. In addition it is simple to calculate the new position of the line SL 2 when the C'-axis is rotated around the B'-axis, because the position of the B'-axis relative to the B-axis is always fixed and known. The importance of this is that the position of the grinding line SL 2, and of the circumference of the trimming wheel 12, remains defined at all times after a one-time resetting, and is unaffected by any movements of the C-axis of the workpiece 7 or any movements of the grinding line SL 1 between the workpiece 7 and the grinding wheel 10. Due to the disposition of the trimming wheel 12 and its positioning by means of the drive 11, it is possible at any time during a grinding process to withdraw the grinding wheel 10 away from the workpiece 7, and then, after translating the turning slide 1 along the Z-axis, to move the said grinding wheel 10 against the trimming wheel which is disposed at a known distance from the A-axis and from the circumference 10' of the grinding wheel, i.e. moving said grinding wheel 10 up to the circumferential line of the trimming wheel 12 or up to the grinding line SL 2, without any requirement for recalibration (re-zeroing). Because the new circumferential line 10' of the grinding wheel 10 can be automatically calculated, on an NC grinding machine, on the basis of the advance of the grinding wheel along the X-axis during the trimming process, after the trimming step the grinding wheel 10 can be brought back automatically into contact with the workpiece 7 (i.e., can be brought back to the grinding line SL 1) in order to continue the grinding, without a recalibration (re-zeroing). Also, after a new workpiece is gripped and held between the turning centers (5, 6), the grinding can be continued with a single resetting of the grinding machine. Namely, it is sufficient to simply re-zero with respect to the new workpiece; the spatial position of the circumferential line of the trimming wheel 12 is not changed when a new workpiece is mounted between the turning centers, and therefore no change in its definition (the definition of the position of the trimming wheel in the NC system) occurs or is required.

Figure 3:
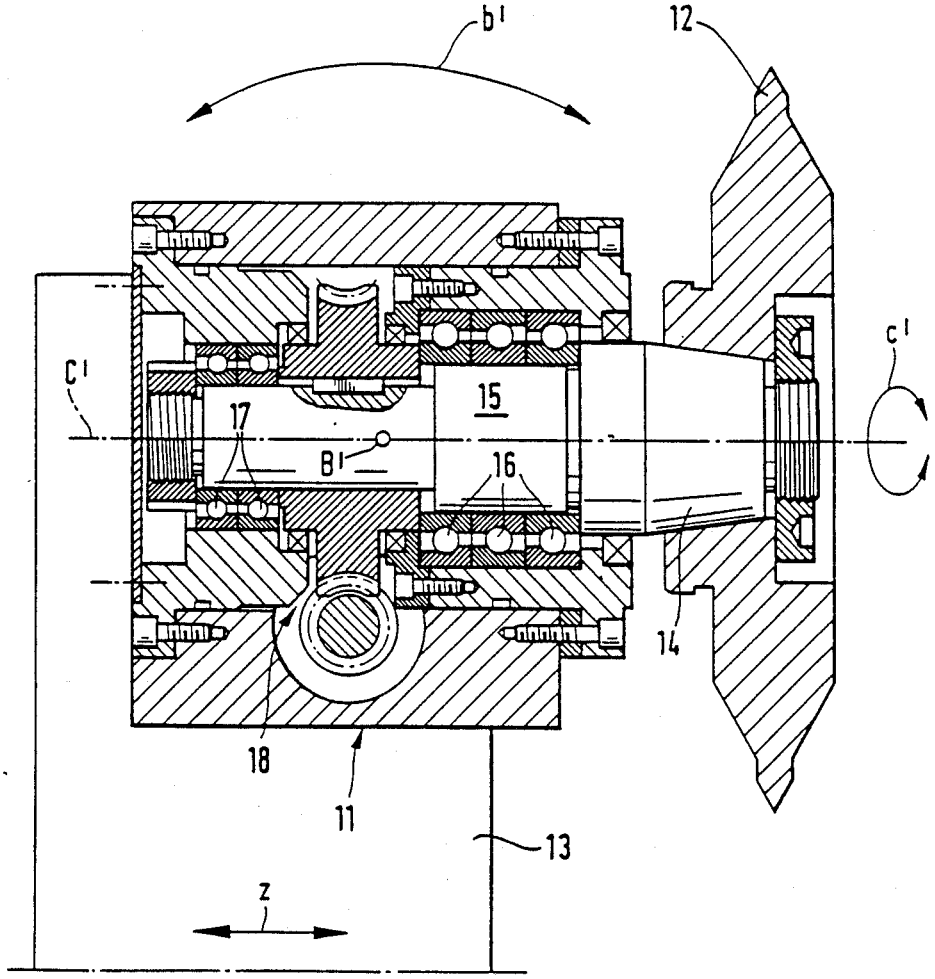
FIG. 3 is a partial cross sectional detail view of the trimming wheel and its mounting device.

FIG. 3 shows that the trimming wheel 12 in the context of the invention is mounted over a conical member 14. The shaft 14 which bears member 14 has two bearings—a front bearing 16 and a rear bearing 17. The consequence of the mounting of the trimming wheel 12 on the shaft 15 via a conical mount and the twofold bearing system of the shaft is that the trimming wheel 12 according to the invention is much more precisely and stablely guided than customary trimming wheels 8, thereby enabling high precision trimming of the grinding wheel. Advantageously, the shaft 15 is driven by a worm drive 18, in either of the directions shown by double arrow c' of FIG. 2, such that the effective cutting speed of the trimming process is adjustable as desired. Because the mounting device for the trimming wheel 12 (FIG. 3) is swingable around the B'-axis (FIG. 2), even profiled grinding wheels can be trimmed; if necessary, during the trimming of a profiled grinding wheel the grinding wheel (10) can be simultaneously translated along the X-axis.

Figure 4:
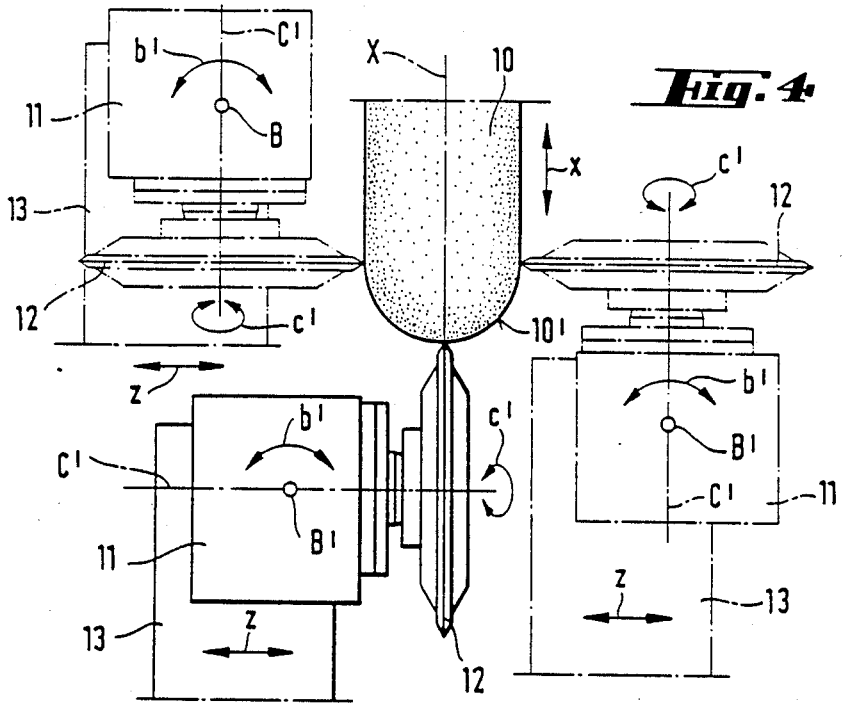
FIGS. 4 and 5 show examples of grinding wheels which cannot be trimmed with customary devices but can be trimmed without problems with the use of the invention.
Figure 5:
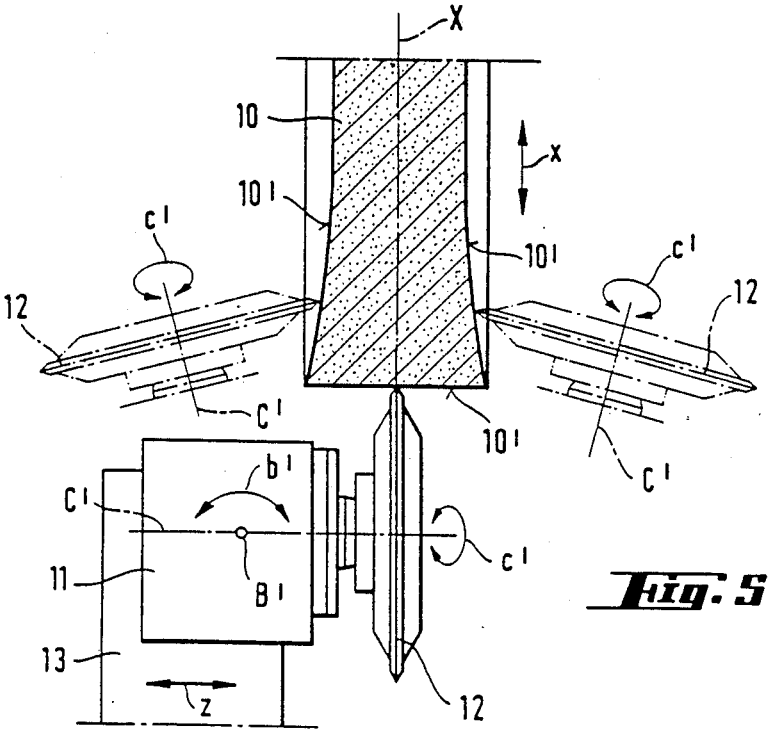

FIGS. 4 and 5 illustrate examples of trimming which cannot be accomplished with customary methods and devices, because such methods and devices do not provide a third controlled and adjustable axis. As a consequence of the motorized drive with respect to the B'-axis of the inventive device, the trimming wheel 12 can execute NC swinging movements around the B'-axis, enabling 3-dimensional trimming of grinding wheels 10. FIG. 4 illustrates this for a grinding wheel 10 with a 180° exterior radius which can be trimmed in such a way that at all times the trimming wheel 12 is perpendicular to the surface of the grinding wheel (and to the circumferential line 10' of the grinding wheel).

Also, using the inventive device one can trim without problems of grinding wheel 10 which is undercut on both sides, as shown in FIG. 5.

One skilled in the art will readily appreciate that the present invention affords substantial advantages over prior trimming techniques for grinding wheels, and that, at the same time, the positioning of the trimming wheel does not affect the zeroing of the C-axis. In addition, the precise and stable guiding of the trimming wheel 12 improves grinding quality without any sacrifice in grinding speed. Further, the invention renders unnecessary a new zeroing of the C-axis after each trimming step, and obviates the physical determination of the position of the grinding line SL 2, between the trimming wheel and grinding wheel, prior to each trimming step. This greatly speeds up the operations on the grinding machine. It is also of advantage that one can adapt practically any modern NC grinding machine, by refitting and reprogramming, to make use of the inventive method.

What is claimed is:

1. In an NC grinding machine comprising a turning slide, said turning slide being translatable along a horizontal axis Z;

a rotary table rotatably mounted on said turning slide, said rotary table being rotatable about a vertical axis B;

a workpiece support means, mounted on said rotary table, for rotatably supporting a workpiece, said workpiece being rotatable about a horizontal axis C;

a rotatable grinding wheel, said grinding wheel being rotatable about a horizontal axis A, said axis A being parallel to said axis Z;

first support means for supporting said grinding wheel for rotation about said axis A, said first support means being translatable along a horizontal axis X, said axis X being perpendicular to said axis Z;

the improvement comprising:

a rotatable trimming wheel, said trimming wheel being rotatable about a horizontal axis C';

a drive means for supporting said trimming wheel for rotation about said axis C' and for rotating said trimming wheel about said axis C', said drive means being rotatable about a vertical axis B', said axis C' intersecting said axis B';

second support means, mounted on said turning slide, for supporting said drive means for rotation about said axis B'.

2. The NC grinding machine according to claim 1, wherein said trimming wheel has a conical bore coaxial with said axis C' therein; and wherein said drive means comprises a rotatable shaft disposed coaxially with said axis C', said rotatable shaft having an end with a conical taper formed thereon, said conical taper engagingly receivable within said conical bore, and bearing means for supporting said rotatable shaft for rotation about said axis C'.

3. The NC grinding machine according to claim 2, wherein said drive means further comprises worm gear means, operatively connected to said rotatable shaft, for rotating said shaft about said axis C'.

4. The NC grinding machine according to claim 3, wherein said bearing means comprises a pair of bearings, a first bearing disposed intermediate said worm gear means and said end of said rotatable shaft with a conical taper formed thereon, a second bearing being disposed on the opposite side of said worm gear means from said first bearing.

* * * * *